US005382084A

United States Patent [19]

Diver et al.

[11] Patent Number: 5,382,084

[45] Date of Patent: Jan. 17, 1995

[54] MILLING DRUM WITH INTERNAL DRIVE MOTOR

[75] Inventors: David R. Diver; Mark R. Kinder; Charles C. Zanetis, all of Brownsburg, Ind.

[73] Assignee: Alitec Corporation, Brownsburg, Ind.

[21] Appl. No.: 98,509

[22] Filed: Jul. 28, 1993

[51] Int. Cl.[6] ..... E01C 23/12

[52] U.S. Cl. ..... 299/39; 299/89

[58] Field of Search ..... 299/39, 76, 78, 89; 404/90

[56] References Cited

U.S. PATENT DOCUMENTS

| | | | |
|---|---|---|---|
| 3,767,262 | 10/1973 | Pentith | 299/10 |
| 4,186,968 | 2/1980 | Barton | 299/39 |
| 4,232,906 | 11/1980 | Torbenson | 299/39 |
| 4,387,929 | 6/1983 | Wirtgen | 299/39 |
| 4,637,753 | 1/1987 | Swisher, Jr. | 404/90 |
| 4,704,045 | 11/1987 | Taylor et al. | 404/90 |
| 4,714,295 | 12/1987 | Wirtgen | 299/39 |
| 4,793,732 | 12/1988 | Jordon | 404/90 |
| 4,878,713 | 11/1989 | Zanetis | 299/39 |
| 5,046,890 | 9/1991 | Dickson | 404/90 |
| 5,078,540 | 1/1992 | Jakob et al. | 404/90 |
| 5,203,615 | 4/1993 | Zanetis et al. | 299/39 |

FOREIGN PATENT DOCUMENTS

| | | | |
|---|---|---|---|
| 4353104 | 12/1992 | Japan | 404/90 |
| 1419714 | 12/1975 | United Kingdom | 299/89 |

*Primary Examiner*—David J. Bagnell

*Attorney, Agent, or Firm*—Baker & Daniels

[57] ABSTRACT

An axially rotatable groundworking implement mountable to a host vehicle. The groundworking implement is powered by two hydraulic motors between the side ends of the groundworking implement. The shaft of each motor includes a bore which functions as either the hydraulic fluid input port or output port for that motor. Each hydraulic motor shaft is nonrotatably affixed to a groundworking implement protective cover. The groundworking implement can be removed from its supporting mechanism without detaching the motor from the work implement.

47 Claims, 6 Drawing Sheets

MILLING DRUM WITH INTERNAL DRIVE MOTOR

FIELD OF THE INVENTION

This invention relates to a rotary apparatus, and, in particular, to a rotary apparatus which utilizes an internally mounted drive system to power the rotation of the apparatus work implement.

BACKGROUND OF THE INVENTION

A variety of interchangeable groundworking apparatuses which are detachably mounted to self-propelled vehicles, such as skid steer front end loaders, are available on the market. As the interchangeability of these groundworking apparatuses provides a single host vehicle with the flexibility to perform a variety of different functions, these types of equipment are highly valued by contractors. This fact results because contractors who perform smaller jobs can utilize a single host vehicle and a variety of groundworking apparatuses to perform a multitude of operations rather than purchasing expensive dedicated machinery for each operation needed to be performed. One type of groundworking apparatus frequently utilized with a self propelled host vehicle is a rotary apparatus such as a cold pavement planer. A representative apparatus is model CP16 cold planar, available from Alitec Corporation of Brownsburg, Ind. This cold planer includes a rotating cylindrical drum or groundworking implement, which is sized to span less than the width of the skid steer loader to which the planar is detachably mounted. The drum is rotationally powered by a hydraulic motor, which utilizes pressurized fluid from a source on the self-propelled vehicle to produce the drum rotation.

A significant shortcoming of many types of rotary apparatuses relates to their inability to necessarily operate over regions in close proximity to obstructions lateral to the rotating drum. For example, planing operations are often necessary to be performed adjacent walls, high curbs, or around other fixed obstructions such as poles. To operate as close as possible to these types of obstructions, the rotating drum must be aligned such that its axis of rotation is perpendicular to the obstruction. In other words, the obstruction is laterally disposed to the ends of the cylindrical drum. During operation of the planar, larger horizontal clearances required between the end of the rotating drum and the obstruction translates to wider regions of unplaned material between the obstruction and the planed area. Previously, horizontal clearance problems relating to the sides of the vehicle have been addressed. A full side shift system taught in U.S. Pat. No. 5,203,615 discloses a rotary apparatus which is laterally shiftable between positions wherein the rotating drum extends beyond either side of the self propelled vehicle. However, while a rotary apparatus can now be extended beyond either side of the vehicle, another clearance problem pertaining to the hydraulic motor which powers the rotation of the apparatus still exists. As disclosed in U.S. Pat. No. 5,203,615, as well as in U.S. Pat. No. 4,878,713, this hydraulic motor typically extends laterally from the drum. As a result, when an operator utilizing a full side shift system laterally shifts the rotary apparatus to plane beyond the same side of the vehicle on which the apparatus motor is disposed, the rotating drum can usually approach the lateral obstruction no closer than approximately the lateral extent of the motor. A closer planing operation can typically be performed by turning the self-propelled vehicle around, laterally shifting the rotary device to the opposite vehicle side, and repeating the planing operation around the obstruction. However, in addition to being highly inconvenient and impossible in certain situations, such a repetitious task is time consuming and therefore costly to a contractor. Therefore, it is highly desireable to provide a rotary apparatus wherein the drive system which powers the spinning drum does not require additional clearance on either side of the drum, thereby facilitating its functioning around obstructions.

Another disadvantage of a rotary apparatus having a motor extending laterally therefrom relates to vertical clearances. For such apparatus constructions, difficulties may be encountered in lowering the rotating drum into a hollow or during use adjacent a stepped incline, such as a curb. For example, when asphalt near a curb is being planed, the hydraulic motor may at first extend unobstructed over the curb. Neither horizontal nor vertical clearance problems for the motor initially exist. As the planing operation progresses and a deeper cut in the asphalt is desired, the drum must be lowered. However, because the hydraulic motor may contact the top of the curb, vertical clearance problems with the motor may prevent further planing. Vertical clearance problems are most serious when a single, large diameter motor, disposed on the outside of the rotating drum, is used to provide the necessary torque instead of two smaller diameter motors, one disposed on either side of the drum.

Rotary devices disposed on dedicated machines, i.e. machines designed primarily for a certain function, have previously utilized hydraulic motors which are either recessed within the sides of the rotary apparatus or located within the rotary apparatus itself. While a construction which recesses the motors reduces the vertical and horizontal motor clearance difficulties described above, this construction suffers from different shortcomings. Specifically, when small motors are disposed on either end of the rotating drum, a pair of hydraulic lines to each motor is presently necessary to provide fluid communication with the pressure source. The presence of independent pairs of hydraulic lines between each motor and the hydraulic pressure source is undesirable for several reasons. First, the large number of lines on the machines provides greater opportunity for mechanical or material failure. Second, the complexity of the connection and disconnection of the hydraulic motors from the hydraulic pressure source is increased. Third, depending on the orientation of the pair of hydraulic lines from each motor, some vertical clearance problems may result. Internally mounted rotary apparatus dual drive systems heretofore taught also suffer from a similar deficiency. Because the hydraulic fluid inlet and outlet lines are disposed on the same side of the drum, vertical clearance problems are also possible.

Another problem with many rotary apparatuses relates to the difficulties of replacing the rotating drum or groundworking implement with an alternate drum. As different planing jobs are best performed with specially designed groundworking implements, operators of rotary apparatuses are constantly having to replace the rotating groundworking implement. For instance, some groundworking implements employ pick structures suited to best plane concrete, while others employ pick structures suited to best plane asphalt. In addition to groundworking implements being specially designed for the material which is being operated over, special tasks require groundworking implements with specially designed pick patterns. For example, one groundworking implement pick pattern only extends six inches along the length of the groundworking implement and is used to plane along cracks to allow for crack repair.

Because of the position and design of the mechanical connections between many prior art groundworking implements and their support structures, disconnection therefrom is labor intensive, highly inconvenient, and time consuming and therefore expensive. For example, in order to disengage the rotating work implement from its protective housing in most cold planer apparatuses, an operator must remove a number of fasteners disposed within the housing itself. An operator must therefore be sufficiently flexible and dexterous to maneuver herself such that she can insert her hands and arms between the inside of the housing and the end of the work implement to work the fasteners. Moreover, because the environment inside the protective housing is likely corrosive due to the basic composition of some materials being planed, the fasteners are likely to corrode and be even more difficult to remove.

The rotational powering of most cold planer groundworking implements also adversely affects the simplicity of detaching the implement from its support structure. Many devices use a gear box attached inside the work implement and rotatable therewith. A motor from outside the protective housing powers the gear box, which converts the input motor shaft rotation into a desirable rate of revolution for the groundworking implement. To remove the work implement, however, requires removal of the motor from engagement with the gear box. This removal is highly undesirable for a variety of reasons. For example, the gasket between the parts is prone to being ripped during removal, and repair is both costly and time consuming. Another major problem is the high likelihood of contamination of the gear box which can quickly lead to its damage or destruction. Work implements are typically changed on construction sites which are notoriously dirty and dusty. When the motor is removed from the apparatus, the shaft is oily and contaminants therefore attach to the shaft. Unless the operator remembers to diligently clean the motor shaft, its insertion into the apparatus gear box, which has been mounted in the next groundworking implement, introduces the contaminants into the gear box. Moreover, oil is likely to spill out. Also, many devices use a single motor in conjunction with a gear box which is cantilevered on one side of the rotating groundworking implement. This orientation puts significant strain on the support bearings, which therefore damage relatively easily and require more frequent replacement.

OBJECTS OF THE INVENTION

Accordingly, one object of the present invention is to provide a rotary apparatus with an internally mounted drive system, thereby allowing for the apparatus to be operated approximately flush with a fixed object such as a pole, wall, curb or other lateral obstruction on either side of the apparatus.

Another object of the present invention is to provide a less expensive rotary apparatus by utilizing an apparatus drive system which supplies sufficient torque for effective operation by means of two smaller and less powerful motors, rather than a larger, more expensive, more powerful single motor.

Another object of the present invention is to provide a rotary apparatus for use with a self-propelled vehicle wherein the dual drive system of the apparatus requires only a single input line and a single output line in fluid communication with the hydraulic source of the vehicle.

A still further object of the present invention is to provide a rotary apparatus which utilizes only a single hydraulic line connected to either side of the apparatus, thereby allowing the apparatus to be lowered farther near a stepped incline, or into a hollow, to perform an operation before the higher portion of the incline contacts the lines.

A still further object of the present invention is to provide a drive system for a rotary apparatus which effectively utilizes two line hydraulic motors and which does not require a gear box mounted internal to the apparatus.

A still further object of the present invention is to provide a rotary apparatus with a groundworking implement which can be readily removed from its surrounding protective housing without an operator introducing her hands in the space inside the protective housing.

A final object of the present invention is to provide a rotary apparatus with a groundworking implement which is readily removable from its surrounding protective housing without removing the motor which power its rotation, thereby facilitating the process of replacing the removed groundworking implement with an alternate groundworking implement.

SUMMARY OF THE INVENTION

In one form thereof, the rotary apparatus of the present invention comprises means for supporting an axially rotatable groundworking implement, an axially rotatable groundworking implement having an axis of rotation and opposing first and second ends, the groundworking implement being rotatable with respect to the axially rotatable groundworking implement supporting means, at least one hydraulic motor comprising a casing, a shaft, and hydraulic fluid input and output ports, the motor casing being substantially disposed between the first and second ends, primary hydraulic fluid input means, primary hydraulic fluid output means, the primary hydraulic fluid input means being in communication with the input port of the at least one hydraulic motor, the primary hydraulic fluid output means being in communication with the output port of the at least one hydraulic motor, such that hydraulic fluid may flow from the input means to the output means through the at least one hydraulic motor, the primary hydraulic fluid input means introducing fluid which passes through the first end of the groundworking implement, and the primary hydraulic fluid output means removing fluid which passes through the second end of the groundworking implement.

In another form thereof, the rotary apparatus of the present invention comprises means for supporting an axially rotatable groundworking implement, an axially rotatable groundworking implement having an axis of rotation and opposing first and second ends, the groundworking implement being rotatable with respect to the axially rotatable groundworking implement supporting means, at least one hydraulic motor comprising a casing, a shaft, and hydraulic fluid input and output ports, the motor casing being substantially disposed between the first and second ends, primary hydraulic fluid input means, primary hydraulic fluid output means, the primary hydraulic fluid input means being in communication with the input port of the at least one hydraulic motor, the primary hydraulic fluid output means being in communication with the output port of the at least one hydraulic motor, such that hydraulic fluid may flow from the input means to the output means through the at least one hydraulic motor, and the casing of the at least one hydraulic motor being affixed to the axially rotatable groundworking implement to thereby be rotatable therewith.

In another form thereof, the rotary apparatus of the present invention comprises means for supporting an axially rotatable groundworking implement, an axially rotatable groundworking implement having an axis of rotation and opposing first and second ends, the groundworking implement being rotatable with respect to the axially rotatable groundworking implement supporting means, at least one hydraulic motor comprising a casing, a shaft, and hydraulic fluid input and output ports, the motor casing being substantially disposed between the first and second ends, primary hydraulic fluid input means, primary hydraulic fluid output means, the primary hydraulic fluid input means being in communication with the input port of the at least one hydraulic motor, the primary hydraulic fluid output means being in communication with the output port of the at least one hydraulic motor, such that hydraulic fluid may flow from the input means to the output means through the at least one hydraulic motor, and the shaft of the at least one hydraulic motor being nonrotatably affixed to the axially rotatable groundworking implement supporting means.

In still another form thereof, the rotary apparatus of the present invention comprises means for supporting an axially rotatable groundworking implement, an axially rotatable groundworking implement having an axis of rotation, the implement being rotatable with respect to the axially rotatable groundworking implement supporting means, at least one hydraulic motor comprising a casing, a shaft, and hydraulic fluid input and output ports, the hydraulic motor shaft comprising a bore therein such that the bore comprises either the hydraulic fluid input port or output port, primary hydraulic fluid input means, primary hydraulic fluid output means, the primary hydraulic fluid input means being in communication with the input port of the at least one hydraulic motor, and the primary hydraulic fluid output means being in communication with the output port of the at least one hydraulic motor, such that hydraulic fluid may flow from the input means to the output means through the at least one hydraulic motor.

In still another form thereof, the rotary apparatus of the present invention comprises means for supporting an axially rotatable groundworking implement, an axially rotatable groundworking implement having an axis of rotation and opposing first and second ends, the groundworking implement being rotatable with respect to the axially rotatable groundworking implement supporting means, at least one hydraulic motor comprising a casing, a shaft, and hydraulic fluid input and output ports, the motor casing being substantially disposed between the first and second ends, primary hydraulic fluid input means, primary hydraulic fluid output means, the primary hydraulic fluid input means being in communication with the input port of the at least one hydraulic motor, the primary hydraulic fluid output means being in communication with the output port of the at least one hydraulic motor, such that hydraulic fluid may flow from the input means to the output means through the at least one hydraulic motor, means for attaching the at least one hydraulic motor to the axially rotatable groundworking implement, means for connecting the at least one hydraulic motor to the axially rotatable groundworking implement supporting means, the connecting means comprising fasteners which are removable to allow the groundworking implement to be removed from the groundworking implement supporting means without detaching the attaching means.

In still another form thereof, the rotary apparatus of the present invention comprise means for supporting an axially rotatable groundworking implement, said means comprising a protective cover having: an interior space which partially receives a groundworking implement, an axially rotatable groundworking implement having an axis of rotation and opposing first and second ends, the groundworking implement being rotatable with respect to the axially rotatable groundworking implement supporting means, at least one hydraulic motor comprising a casing, a shaft, and hydraulic fluid input and output ports, the motor casing being substantially disposed between the first and second ends, primary hydraulic fluid input means, primary hydraulic fluid output means, the primary hydraulic fluid input means being in communication with the input port of the at least one hydraulic motor, the primary hydraulic fluid output means being in communication with the output port of the at least one hydraulic motor, such that hydraulic fluid may flow from the input means to the output means through the at least one hydraulic motor, means for attaching the at least one hydraulic motor to the axially rotatable groundworking implement, means for connecting the at least one hydraulic motor to the axially rotatable groundworking implement supporting means, the connecting means comprising fasteners which are removable to allow the groundworking implement to be removed from the groundworking implement supporting means, and wherein the fasteners are positioned to be disconnectable from the groundworking implement supporting means at a location exterior to the protective cover interior space.

DETAILED DESCRIPTION

Figure 1:
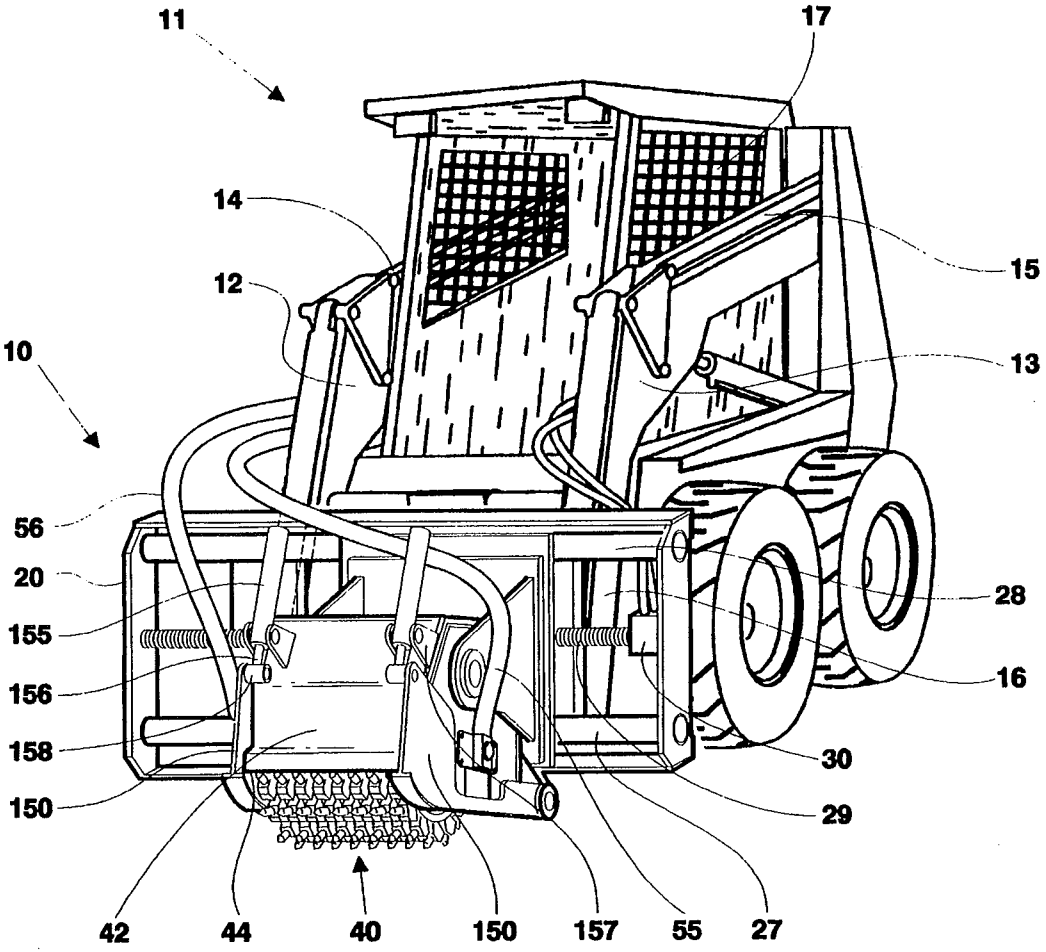
FIG. 1 shows a perspective view of the rotary apparatus of the present invention mounted on a front end loader.

Referring now to FIG. 1, there is shown a perspective view of a rotary apparatus which is particularly well suited for and benefitted by the utilization of the drive system of the present invention. In this embodiment, the rotary apparatus is more particularly a cold planer mechanism 10 which is mounted to self-propelled vehicle 11, such as the skid steer front end loader model 853H made by Melroe Company of Gwinner, N. Dak. or model 1840 or 1845C made by J.I. Case of Racine, Wis. As is conventional, loader 11 includes a hydraulic pressure source. Lift arms 12, 13 each extend outwardly adjacent opposite sides 14, 15, respectively, of loader 11 and are able to swing up and down in unison. Each lift arm 12, 13 provides an attachment means 16 which permits the removable mounting of planer mechanism 10 to arms 12, 13. Loader 11 also includes cab 17 from which an operator controls loader 11 and planer mechanism 10.

Figure 2:
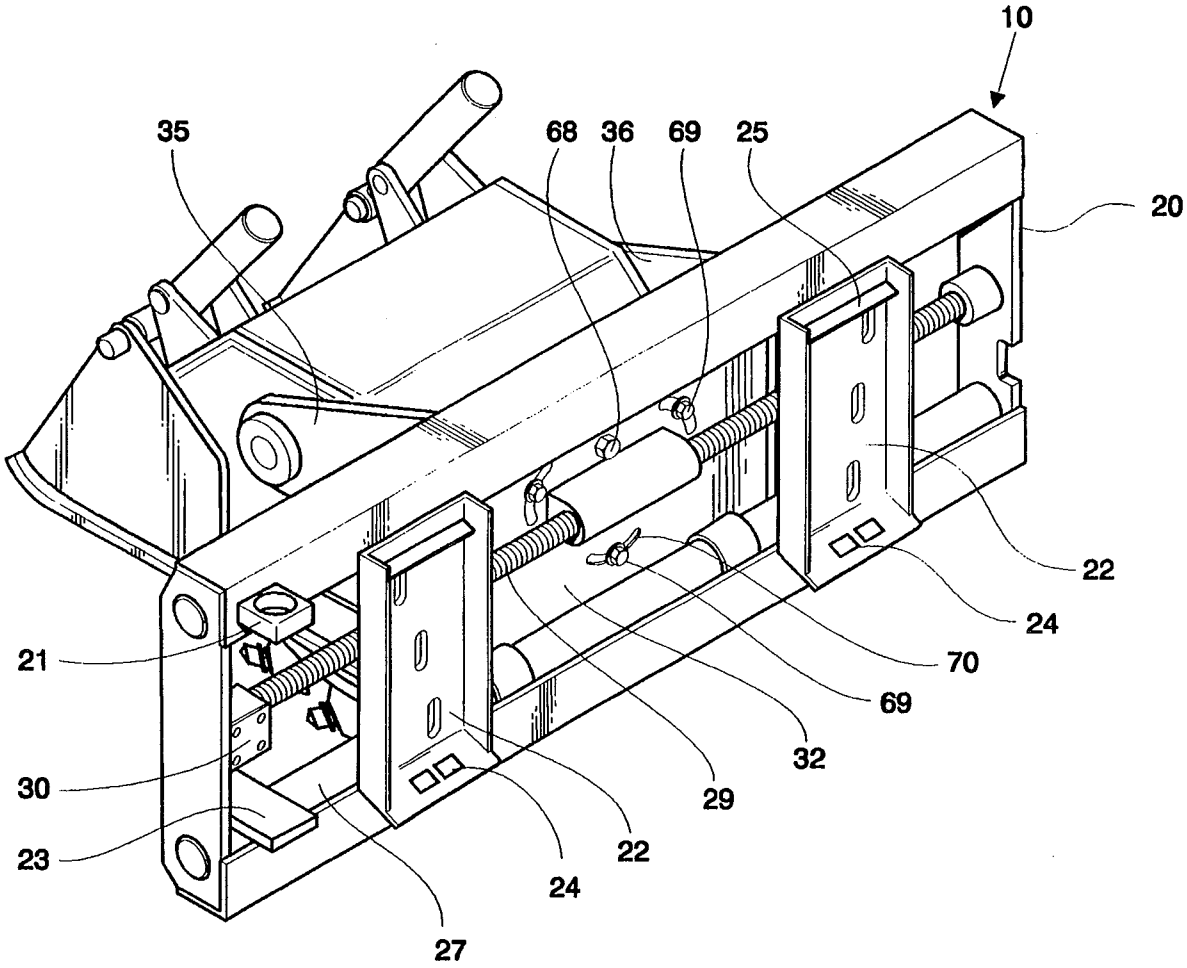
FIG. 2 shows a rear perspective view of the rotary apparatus of the present invention which has been detached from the front end loader.

Cold planer mechanism 10 includes frame 20 as well as ground engagable axially rotatable groundworking implement 40. The rearward side of frame 20 includes a pair of spaced apart wings 22 (see FIG. 2) rigidly attached thereto. Apertures 24 and bars 25 in each wing 22 together cooperate with the mating attachment means 16 of lift arms 12, 13 to detachably mount planer mechanism 10 to loader 11. While these means of connecting apparatuses to loaders are standard, other means are also feasible and acceptable substitutes. Frame 20 also includes pick tool holder 21, designed to conveniently store the tool used to work on picks 64 of groundworking implement 40 until needed, and serrated step 23, which aids an operator in entering cab 17. Disposed between the sides of frame 20 are support rods 27, 28 and threaded worm screw 29, which is rotationally powered by hydraulic motor 30. Rods 27, 28 and screw 29 connect to and cooperate with rear support member 32, which is part of the structure supporting work implement 40, to function according to the teachings of the full side shift system disclosed in U.S. Pat. No. 5,203,615, which is herein incorporated by reference. As a result, rear support member 32, as well as groundworking implement 40 which is connected thereto as described hereinafter, is laterally shiftable with respect to frame 20 and loader 11.

Figure 3:
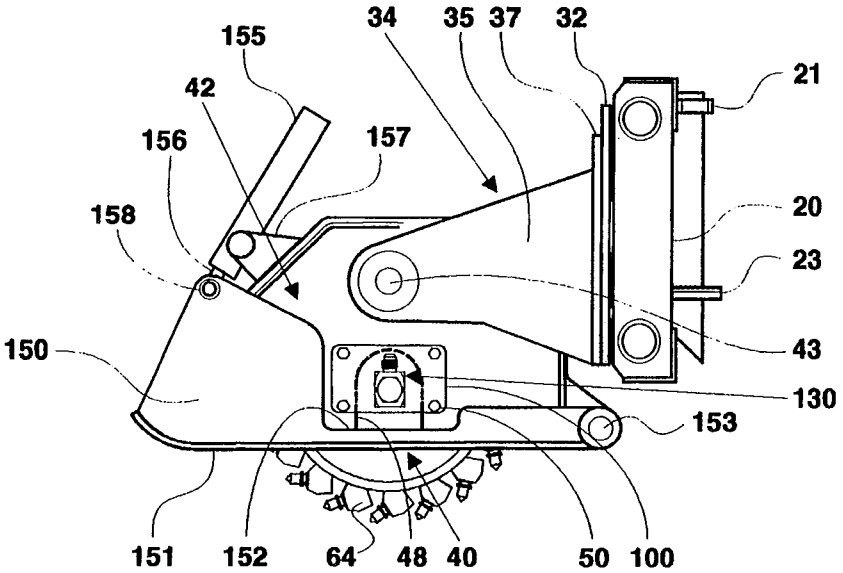
FIG. 3 shows a side view or the rotary apparatus of FIG. 2, wherein the depth control skids are oriented to allow the apparatus to perform a deep planing operation.

The components utilized to support axially rotatable groundworking implement 40 from frame 20 are primarily shown in the side view of cold planer mechanism 10 in FIG. 3. A yoke, generally designated 34, is generally a squared C in shape. Yoke 34 includes opposing left and right rigid support arms 35, 36 and connecting base plate 37 therebetween. At its center, base plate 37 is coupled by pivot bolt 68 (see FIG. 2) with rear support member 32 such that plate 37 may rotate relative to member 32. Guide bolts 69, which move within arcuate guide slots 70 in support member 32, further couple the components and limit the relative movement. The range of motion provided by this coupling allows plate 37 to be moved to an orientation where its upper edge is horizontally tilted in comparison to the upper edge of member 32. This orientation is effected when support arms 35, 36 assume different vertical heights when axially groundworking implement 40 is tilted as more fully described below. Opposing support arms 35, 36, which respectively flank housing left side 45 and housing right side 46, are linked to housing 42 by connection means 43 disposed at the forward end of arms 35, 36. Connection means 43 permits housing or protective cover 42 to pivot relative to support arms 35, 36.

In the embodiment illustrated, housing 42 functions both to cover groundworking implement 40, thereby preventing accidental contact with the rotating device, and support groundworking implement 40. Housing 42 is sized and shaped to partially receive groundworking implement 40 within its interior volume or space 47. Housing 42 substantially covers the upper half of axially rotatable groundworking implement 40 and includes a bottom edge 44 having left, right, front and rear portions. While visible in FIG. 1, bottom edge 44 is not visible in FIG. 3 as it is positioned behind skid 150. The left portion of bottom edge 44, located on housing left side 45, and the right portion of bottom edge 44, located on housing right side 46, are each interrupted by upwardly extending opening 48. Two pairs of holes, which receive bolts or fasteners 50, are formed in each housing side 45, 46 adjacent opening 48. Openings 48 each serve as a passageway to accommodate the hydraulic fluid, used by the internally mounted motors to drive the rotation of groundworking implement 40, which is introduced by primary hydraulic fluid input line 55 and removed by primary hydraulic fluid output line 56.

Figure 4:
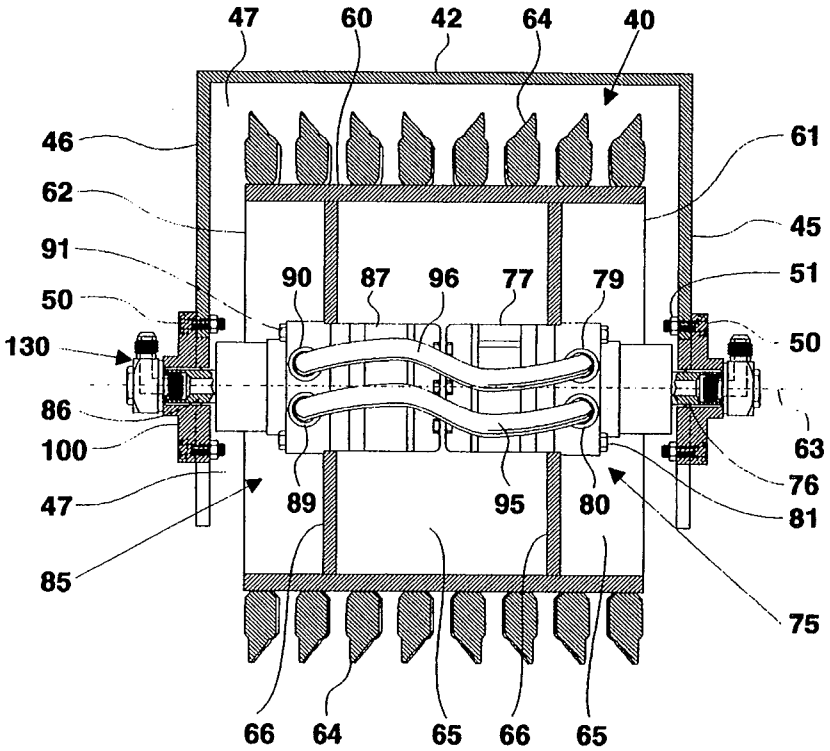
FIG. 4 shows a partial sectional front view of the groundworking implement and its connection to the protective cover of the rotary apparatus of FIG. 3, taken along a vertical plane passing through the groundworking implement axis of rotation, wherein the depth control mechanisms and yoke support arms are not shown and wherein the first and second motor casings and hydraulic fluid fittings are not shown in section.

As best shown in FIG. 4, axially rotatable groundworking implement 40 comprises cylindrical drum 60 and includes left end 61, opposing right end 62 (directions from an operator's perspective), and an axis of rotation 63. Rows of picks 64 are disposed on the radially exterior surface of drum 60 and extend outward. Drum 60 has a substantially hollow interior 65 divided into three sections by two substantially doughnut shaped discs 66. Each disc 66 is fixedly, i.e. non-rotationally, secured at its perimeter to the interior surface of drum 60. A pair of structurally identical motors 75, 85, arranged with their shafts disposed coaxial with axis of rotation 63, power the rotation of groundworking implement 40 as well as serve to supportively connect groundworking implement 40 with protective cover 42.

Figure 6:
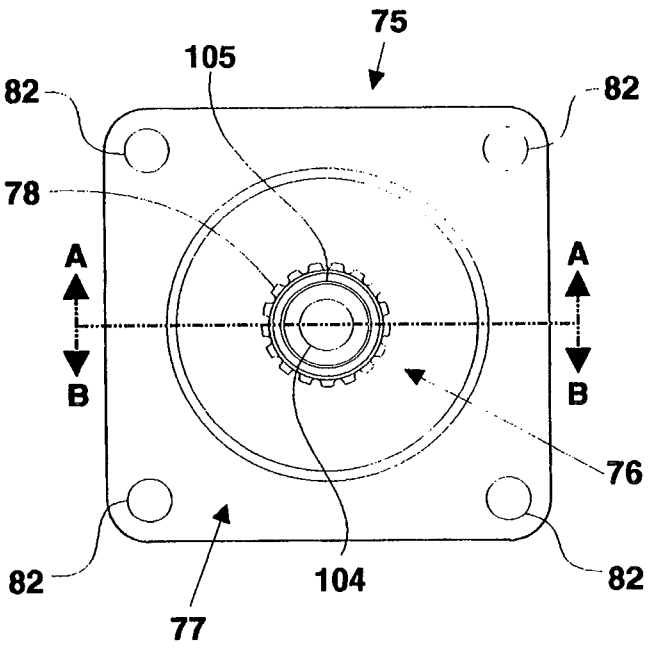
FIG. 6 shows an end view or the first motor of FIG. 4, shown separate from the remainder of the rotary apparatus and as viewed when looking directly into the motor shaft.
Figure 5:
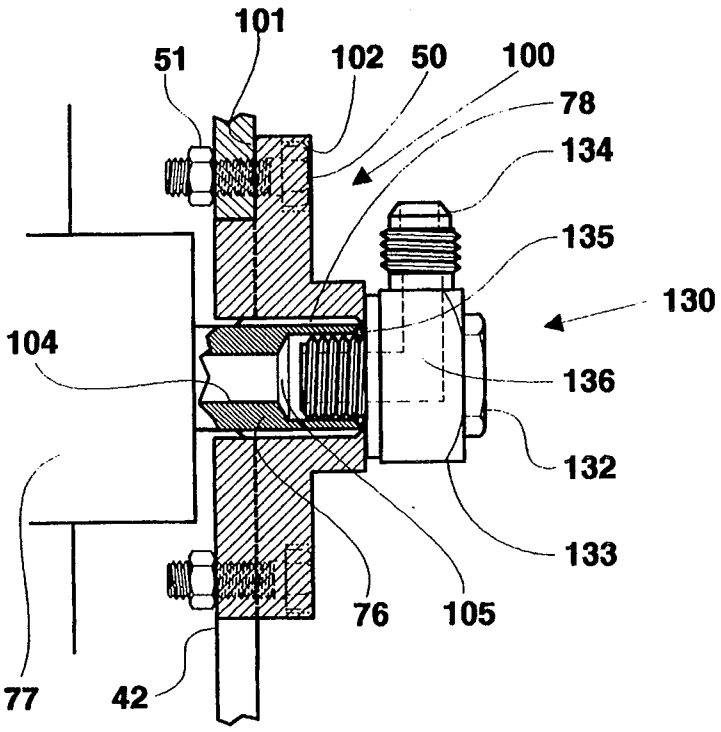
FIG. 5 shows a magnified view from FIG. 4 of the engagement of the first motor shaft with the support hub and hydraulic fluid fitting.

Referring to FIGS. 4–6, motor 75 includes casing 77 and shaft 76, which are conventionally coupled so as to be rotatable relative to one another. Casing 77 includes two hydraulic ports, namely an A-type port 79 and a B-type port 80, in fluid communication with the internal mechanical workings of motor 75. The type designations of ports 79, 80 will be more particularly described in reference to the circuiting of the hydraulic fluid utilized in powering motor 75. Four bolts 81 insert through holes 82 in casing 77 to attach or connect casing 77 to disc 66. Relative rotation between casing 77 and disc 66 is thereby prevented. Casing 77 is substantially disposed between left end 61 and right end 62 of drum 60, meaning that at least a significant portion and up to all of the length of casing 77 does not extend beyond the left end 61 of drum 60. Because motor 85 is identical to motor 75, the various components, namely casing 87, shaft 86, A-type port 89, B-type port 90, and bolts 91 are identically constructed and connected. A pair of secondary hydraulic lines or hoses 95, 96, which pass through an enlarged portion of the centered hole in disc 66 which receives motors 75, 85, link together the casing motor ports. Secondary hydraulic line 95 provides fluid communication between B-type port 80 of motor 75 and A-type port 89 of motor 85. Secondary hydraulic line 96 provides fluid communication between A-type port 79 of motor 75 and B-type port 90 of motor 85.

As best shown in FIGS. 5 and 6, the detachable connection or coupling of groundworking implement 40 to protective cover 42 at left end 61 involves motor 75. Because the connection which occurs at opposing right end 62 is identical, that connection will also be understood from the following. The end of motor shaft 76 farthest from casing 77 is constructed with a plurality of longitudinal splines 78 disposed around the circumference of shaft 76. Splines 78 are received and mate with a complementary shaped opening in rigid support hub 100, thereby preventing relative rotation between support hub 100 and shaft 76. In other words, support hub 100 is non-rotationally coupled with shaft 76. Support hub 100 has a two tiered inward surface shaped to fit into or mate with the upward region of opening 48, and the nonprotruding portion 101 of hub 100 contacts cover 42. Support hub 100 also includes four recesses 102 which accommodate the heads of bolts 50. Bolts 50 and nuts 51 are utilized to detachably connect protective cover 42 to support hub 100 such that relative rotation therebetween, as well as other movement, is prevented. Nut 51 is preferable welded to the inside surface of left side 45 of housing 42 such that fasteners 50 can be tightened without requiring an operator reach inside housing 42.

Although conventional in the sense that groundworking implement 40 is rotatable with respect to its support structure, which includes for example yoke 34 and protective cover 42, it will be appreciated by those of skill in the art that the standard dynamic of the motors driving groundworking implement 40 is reversed. Specifically, as motor shafts 76, 86 are nonrotatably affixed, by means of intermediate support hub 100, to protective cover 42, which does not revolve during operation of cold planar mechanism 10, shafts 76, 86 do not rotate during the axial rotation of groundworking implement 40. And, as motor casing 77, 87 are affixed to axially rotatable groundworking implement 40 to thereby be rotatable therewith, rotation of groundworking implement 40 during operation of cold planar mechanism 10 results from the rotation of casings 77, 87 relative to shafts 76, 86.

Figure 7A:
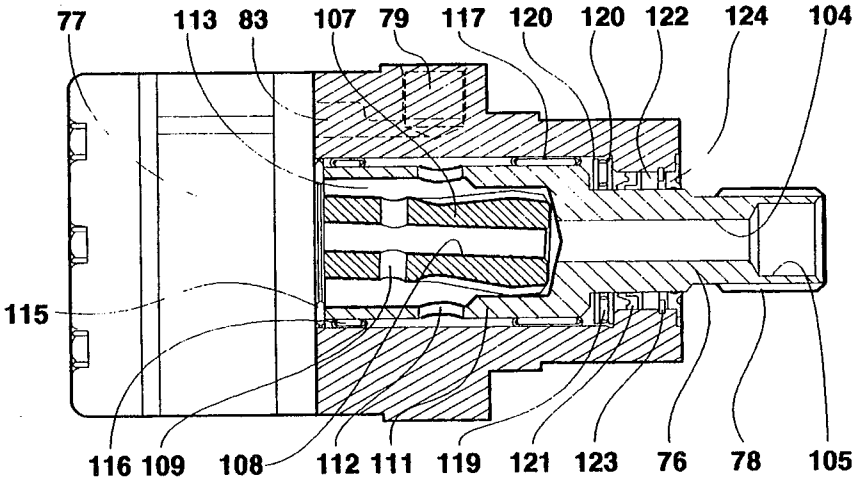
FIGS. 7A and 7B show opposing cutaway views of the motor of FIG. 6, wherein in each figure the exterior motor casing is shown which surrounds the gerotor motor mechanism and wherein the ports and motor construction which substantially provide the hydraulic fluid communication within the motor are shown in section as taken along lines A—A and B—B, respectively, of FIG. 6.
Figure 7B:
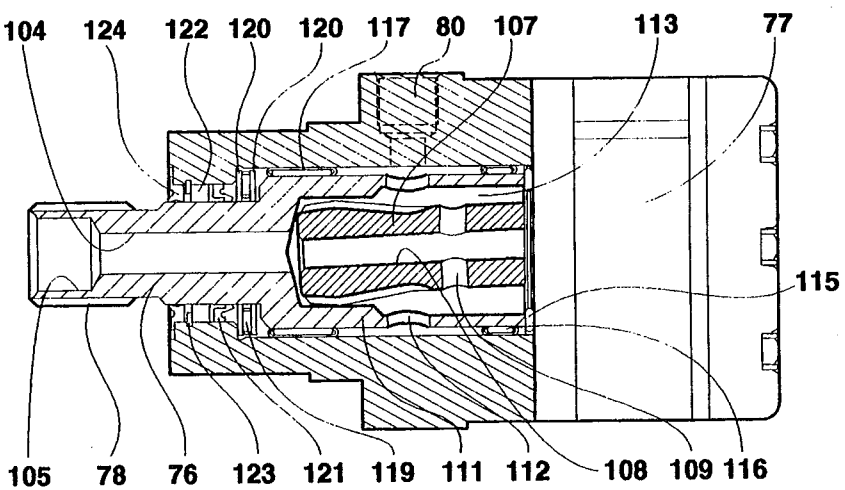

Motors 75, 85 which are employed in the illustrated embodiment of the present invention are standard, high volume, low speed/high torque, two-port motors which have been slightly modified to provide a desired hydraulic fluid circuiting. As motor 75, 85 are themselves structurally identical, explanation will be directed to motor 75 but will have equal application to motor 85. Motor 75 is specifically a RE Series gerotor type motor manufactured by White Hydraulics. The above referenced design modifications relate to motor shaft 76, which is typically solid in construction. As shown in the partial cross sectional views of motor 75 in FIGS. 7A and 7B, shaft 76 has been modified to include longitudinal bore 104 and a larger diameter fitting receiving bore 105, which is internally threaded. While it is preferable that longitudinal bore 104 be axially disposed within shaft 76 and therefore be coaxial with axis of rotation 63, and that fitting receiving bore 105 be coaxial with bore 104, such a construction is unnecessary for proper functioning of the invention. The remainder of motor 75 is unchanged and well known to those familiar with such motors. For instance, drive link or wobble shaft 107 is coupled with motor shaft 76 and includes chamfered axial bore 108 and transverse bore 109. Coupling shaft shell 111 includes a plurality of radial holes 112 and, in conjunction with drive link 107, defines cavity 113. Motor 75 also includes thrust bearing 115, radial bearings 116, 117, thrust bearing 119 between annular washers 120, high pressure shaft seal 121, seal back-up 122, snap-ring 123, and dirt and water seal 124. Normally, or in other words when motor 75 is not modified as described above, the hydraulic fluid is circuited such that high pressure fluid is input into motor 75 via B-type port 80 (FIG. 7B in shadow), passes through radial holes 112 and into cavity 113, and then continues rearwardly where it passes through the gap between thrust bearing 115 and drive link 107, through a valve, and into the gerotor motor mechanism (not shown) which utilizes the fluid pressure to power the normal rotation of shaft 76 relative to casing 77. The fluid, at a lower pressure, then exits motor 75 by passing from the gerotor motor mechanism into channel 83 and A-type port 79 (FIG. 7A in shadow). The designation B-type port refers to ports which provide direct fluid communication with cavity 113, while the designation A-type port refers to ports which do not provide direct fluid communication with cavity 113 but rather are fluidly connected with the gerotor mechanism.

In the hydraulic fluid circuit of the present invention, the shaft modifications result in longitudinal bore 104 and fitting receiving bore 105 being in direct fluid communication with cavity 113 substantially via drive link axial bore 108 and transverse bore 109. As a result, longitudinal bore 104 and fitting receiving bore 105 are also in fluid communication with B-type port 80. In effect, the modification has changed standard two port motor 75 into a three hydraulic fluid port motor.

Referring again to FIG. 5, the end of motor shaft 76 receives banjo fitting 130, which comprises bolt 132, intermediate member 133, and hydraulic hose receiver 134. A fluid passageway 136 shown in shadow is formed therein. Bolt 132, which passes through intermediate member 133 and includes a transverse hole to connect with passageway 136, is hollow and externally threaded and engages the threads of fitting receiving bore 105. O-ring 135 prevents fluid leakage between the interconnection of banjo fitting 130 and motor shaft 76. Hydraulic hose receiver 134 associated with motor 75 is designed to receive one end of primary hydraulic fluid input line 55, the other end of which is connectable to the hydraulic pressure source of loader 11. The banjo fitting 130 disposed on motor shaft 86 is similarly constructed, and the hydraulic hose receiver 134 thereat is designed to receive one end of primary hydraulic fluid output line 56, the other end of which is also connectable to the hydraulic pressure source of loader 11.

Figure 8:
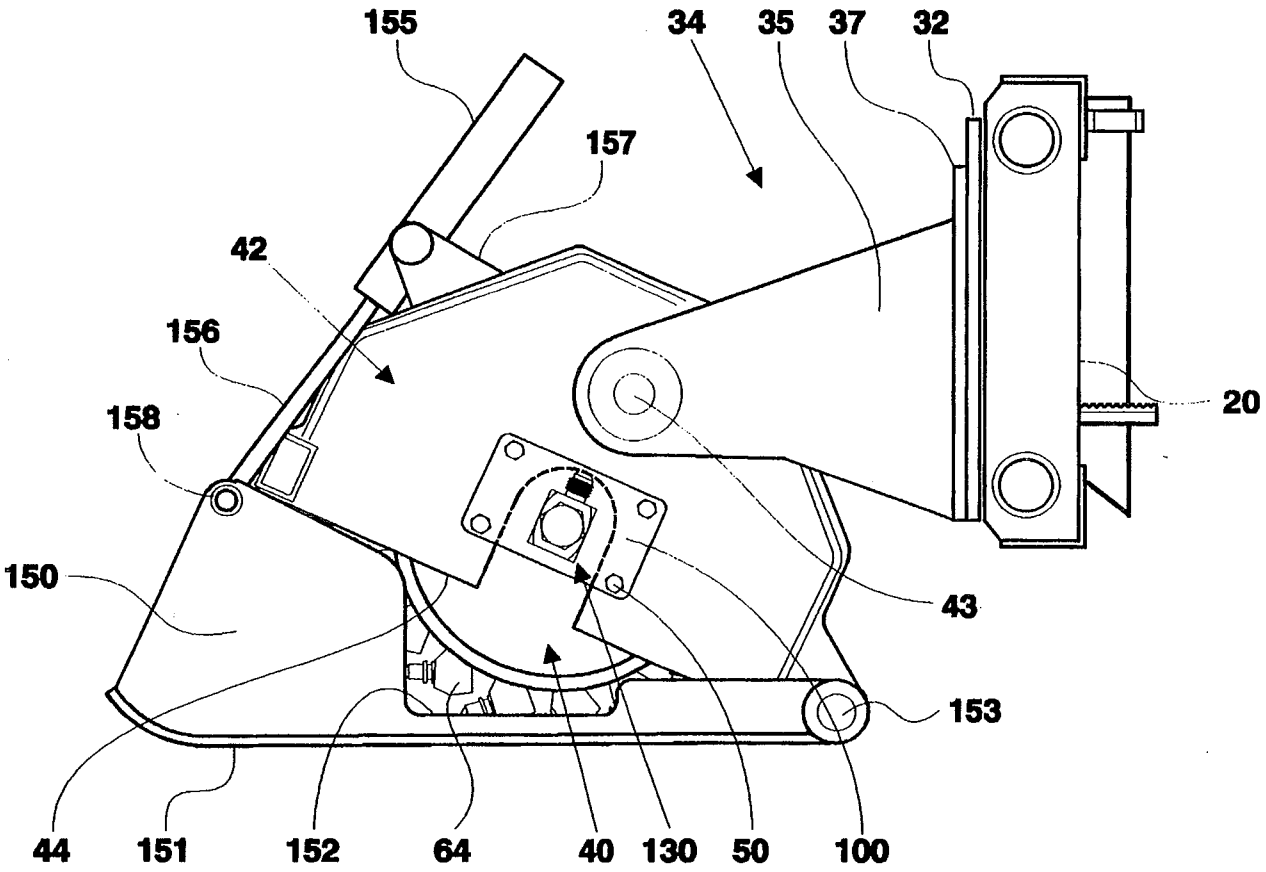
FIG. 8 shows a side view of the rotary apparatus of FIG. 3 wherein the depth control skids are oriented to allow the apparatus to perform a zero cut planing operation.

The planing depth control and tilt control of axially rotatable groundworking implement 40 are effected through the use of a pair of mirror image skids 150, one of which is disposed on either opposing end of groundworking implement 40 as shown in FIG. 1. Referring to FIGS. 3 and 8, each skid 150 includes a ground engaging or lower surface 151 and upper surface 152. Skid 150 is shaped such that upper surface 152 does not contact or interfere with banjo fitting 130 and support hub 100, even when skid 150 is fully retracted. The rearward end of skid 150 includes a connection device 153 to pivotally connect skid 150 to protective cover 42, The forward end of skid 150 is connected via pin 158 to piston shaft 156 of hydraulic cylinder 155, which is turn is mounted via bracket 157 to protective cover 42. The hydraulic lines to cylinder 155 are not shown. When groundworking implement 40 is to be moved to provide a different planing depth, each hydraulic cylinder 155 is actuated to extend or retract, depending on the depth desired, piston shaft 156. This action causes protective cover 42 to move with respect to skids 150. More particularly, because skid 150 contacts the ground, the movement of piston shaft 156 causes protective cover 42 to rotate about connection 43 and for skid 150 to pivot relative to cover 42 about connection 153. FIG. 3 illustrates the orientation of skids 150 relative to protective cover 42 when groundworking implement 40 is in the maximum depth cut position. FIG. 8 illustrates the orientation of skids 150 relative to protective cover 42 when groundworking implement 40 is in the zero cut position, which is useful, for example, for milling a plastic tape stripe off a road.

The movement of protective cover 42 relative to skids 150 also can effect a tilting of groundworking implement 40. For instance, when it is desired that groundworking implement 40 be tilted, i.e. opposing ends of groundworking implement 40 are positioned at different heights, hydraulic cylinders 155 are actuated such that piston shafts 156 are moved to different extensions. This tilting movement causes support arms 35, 36 to move to separate heights, which means that connecting base plate 37 must therefore rotate about its center to a non-horizontal orientation as mentioned previously. When groundworking implement 40 has been tilted and then plunged to its deepest cutting depth, the ground engaging surface 151 of the skid 150 which is more fully retracted, i.e. the skid with its associated piston shaft 156 more fully retracted or recessed within hydraulic cylinder 155, will be flush with the ground. The skid 150 on the opposing side of groundworking implement 40, however, will not be flush. Rather, while the forward portion of that skid 150 will contact the ground, the pivotal connection 153 will be lifted off the ground. If desired, skid 150 could be replaced with a wheel assembly connected to piston shaft 156 to provide the same depth and tilt control.

As will be appreciated from the foregoing description, the flow of hydraulic fluid through the illustrated embodiment of the present invention can be explained abstractly as follows. Primary hydraulic fluid input line 55 is in fluid communication with motor 75, which is substantially disposed internal to groundworking implement 40. High pressure hydraulic fluid passes therebetween by being introduced to motor 75 through left end 61 of groundworking implement 40. Motor 85 is similarly substantially disposed internal to groundworking implement 40 and is in fluid communication with motor 75 via secondary hydraulic lines 95,96. Motor 85 is also in fluid communication with primary hydraulic fluid output line 56. The pressure of the hydraulic fluid is used to power motors 75, 85 to rotate groundworking implement 40. As a result, low pressure hydraulic fluid passes between motor 85 and output line 56 by being removed from motor 85 through opposing right end 62 of groundworking implement 40.

More specifically, the operative rotation of groundworking implement 40 of cold planar mechanism 10 is produced by circuiting hydraulic fluid as follows. High pressure hydraulic fluid from the loader hydraulic pressure source passes through primary hydraulic fluid input line 55, through banjo fitting 130, and into longitudinal bore 104 of shaft 76, which serves as the input port for motor 75. The high pressure hydraulic fluid continues through axial bore 108 and transverse bore 109 of drive link 107 and arrives at cavity 113. At this point, the hydraulic fluid is naturally or automatically split because the motors are coupled in parallel fluid communication. One half the high pressure hydraulic fluid passes through radial holes 112, through B-type port 80, and into secondary hydraulic line 95. The remaining high pressure hydraulic fluid simultaneously passes into the gerotor motor mechanism where its pressure is utilized to rotate casing 77 relative to fixed shaft 76. And, because shaft 76 is non-rotationally coupled with protective cover 42, casing 77 necessarily is forced to revolve and thereby rotate disc 66 and drum 60. The hydraulic fluid, at a resulting low pressure, then passes from the gerotor motor mechanism through channel 83 and A-type port 79, and into secondary hydraulic line 96. B-type port 80 and A-type port 79 both serve as output ports for motor 75.

The high pressure hydraulic fluid in secondary hydraulic line 95 continues to motor 85 and inputs into A-type port 89. This fluid passes through the channel connected with A-type port 89 and into the gerotor motor mechanism where its high pressure is utilized to rotate casing 87 relative to fixed shaft 86. This fluid, at a resulting lower pressure, then passes into the cavity of motor 85 corresponding to cavity 113 of motor 75. Meanwhile, the low pressure hydraulic fluid in secondary hydraulic line 96 also continues to motor 85 and inputs into B-type port 90. This fluid then passes through the radial holes of the coupling shaft shell of motor 85 and into the cavity corresponding to cavity 113 of motor 75. At this point, the high pressure fluid which had previously been divided or split in motor 75 is reunited at a lower pressure. The entire amount of fluid then continues together through the transverse bore and axial bore of the drive link, and into the longitudinal bore corresponding to longitudinal bore 104 of motor 75. The lower pressure fluid then continues through banjo fitting 130, through primary hydraulic fluid output line 56, and returns to the hydraulic pressure source of loader 11. B-type port 90 and A-type port 89 both serve as input ports for motor 85, and the longitudinal bore of shaft 86 serves as the output port for motor 85.

Those of skill in the art will appreciate that forcing fluid through motor 85 in this manner, i.e. the input of pressurized fluid to the gerotor motor mechanism through the A-type port rather than the B-type port, results in a directional rotation of casing 87 relative to shaft 86 which is opposite to the rotation of casing 77 relative to shaft 76. However, because motor shaft 86 of motor 85 is pointed 180° from motor shaft 76 of motor 75, the net effect of the configuration of motors 75, 85 and their hydraulic circuiting is that casings 77, 87 revolve together and combine to effectively rotate groundworking implement 40.

As is evident from the foregoing disclosure, the present invention provides a rotary apparatus with a variety of desirable and beneficial features. Because the drive system of the invention, which comprises drive motors 75, 85, is primarily mounted internally to groundworking implement 40 rather than externally, cold planar mechanism 10 may be operated approximately flush with a fixed object such as a pole, wall, curb or other lateral obstruction on either side of planar mechanism 10. As motors 75, 85 work together to supply sufficient torque to operate groundworking implement 40, the use of a larger, more expensive, more powerful single motor to provide torque can be avoided. Furthermore, because of the hydraulic circuiting through motors 75, 85, cold planar mechanism 10 provides a groundworking implement powered by two motors which only requires a single input line 55 and a single output line 56 providing fluid communication between groundworking implement 40 and the hydraulic source of the self-propelled vehicle 11. Moreover, as primary hydraulic fluid lines 55, 56 are connected to separate ends of groundworking implement 40 rather than the same end, and because these are the only hydraulic fluid lines providing for the operational rotation of groundworking implement 40, implement 40 may be lowered farther near a stepped incline, or into a hollow, to perform an operation before the higher portion of the incline contacts lines 55, 56. The novel manner of powering groundworking implement 40 dispenses with the need to mount a gear box internally to groundworking implement 40, as well as allows two hydraulic line motors to be used instead of motors which require a case drain hose to remove leaked fluid. Furthermore, the ability of groundworking implement 40 to be readily removed or detached from its support means, i.e. protective cover 42 in the illustrated embodiment, facilitates the process of replacing the removed groundworking implement with an alternate groundworking implement. To remove groundworking implement 40, skids 150 are first extended to their zero cut position as shown in FIG. 3 and then hydraulic lines 55, 56 are detached. Bolts 50 are then disconnected from both sides of cold planar mechanism 10, and as a result groundworking implement 40 rests on the ground. Next, the entire support structure is slightly raised and laterally shifted such that a banjo fitting 130, for explanation purposes the fitting disposed beyond left end 61 of groundworking implement 40, moves through the gap between upper surface 152 of skid 150 and protective cover 42 until fitting 130 is clear of skid 150. The banjo fitting 130 disposed beyond right end 62 of groundworking implement 40 is not clear of skid 150. Upon further elevation of the support structure, while left end 61 rests upon the ground, right end 62 of groundworking implement 40 is tipped upward as that skid 150 beyond right end 62 contacts and lifts that fitting 130. When raised a sufficient distance, banjo fitting 130 slides off skid 150 and groundworking implement 40 drops to the ground and is completely removed or clear of housing 42. Next, simply by removing bolts 81, 91 and hydraulic lines 95, 96, motors 75, 85 are detached and removable from groundworking implement 40. Secondary hydraulic lines 95, 96 are of adequate length to allow one motor to be removed enough to disengage the lines from the motor ports during motor removal. Then, motors 75, 85 can be inserted into an alternate groundworking implement, which in turn is mounted to the support structure of cold planar mechanism 10 by propping the implement at a sufficient tilt and reversing the steps discussed above. It is also possible to remove groundworking implement 40 without detaching hydraulic lines 55, 56. This procedure requires that skids 150 first be removed. Bolts 50 are then disconnected from both sides of cold planar mechanism 10 such that groundworking implement 40 rests on the ground, and then the entire support structure is raised to expose work implement 40 and thereby remove it from housing 42. Thus, the only mechanical disconnection required to initially remove work implement 40 from interior space 47 of protective cover 42 involves removing bolts 50, which are positioned at a location exterior to the protective cover interior space 47. Bolts 50 can therefore be removed without an operator having to introduce her hands into interior space 47. It will also be appreciated that work implement 40 can be removed from protective cover 42 without removing bolts 81, 91, thereby allowing motors 75, 85 to remain attached to work implement 40 until an appropriate and convenient time.

While this invention has been described as having a preferred design, the present invention can be further modified within the spirit and scope of this disclosure. For instance, in addition to application with gerotor type motors, the teachings of the present invention are readily applicable to other types of motors such as radial piston motors. Also, a single motor, instead of the two motors illustrated, could be utilized. Also, instead of being coupled in parallel fluid communication, the two motors could by coupled in serial fluid communication. Furthermore, electric motors, if sufficiently powerful, could replace the disclosed hydraulic motors. Moreover, instead of attaching to the protective cover, the support arms of the yoke could be attached to the motor shafts directly, and the protective cover could in turn be pivotally connected to the motor shafts. Therefore, this application is intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A rotary apparatus comprising:

means for supporting an axially rotatable groundworking implement, an axially rotatable groundworking implement having an axis of rotation and opposing first and second ends, the groundworking implement being rotatable with respect to the axially rotatable groundworking implement supporting means, at least one hydraulic motor comprising a casing, a shaft, and hydraulic fluid input and output ports, the motor casing being substantially disposed between the first and second ends, primary hydraulic fluid input means, primary hydraulic fluid output means, the primary hydraulic fluid input means being in communication with the input port of the at least one hydraulic motor, the primary hydraulic fluid output means being in communication with the output port of the at least one hydraulic motor, such that hydraulic fluid may flow from the input means to the output means through the at least one hydraulic motor, the primary hydraulic fluid input means introducing fluid which passes through the first end of the groundworking implement, and the primary hydraulic fluid output means removing fluid which passes through the second end of the groundworking implement.

2. The rotary apparatus of claim 1 wherein the motor input port in communication with the primary hydraulic fluid input means and the motor output port in communication with the primary hydraulic fluid output means are coaxial with the axis of rotation of the axially rotatable groundworking implement.

3. The rotary apparatus of claim 1 wherein the shaft of the at least one hydraulic motor further comprises a bore therein such that the bore comprises either the hydraulic fluid input port or output port.

4. The rotary apparatus of claim 1 wherein the at least one hydraulic motor comprises a first motor and a second motor, the first motor being in fluid communication with the second motor.

5. The rotary apparatus of claim 4 wherein the shafts of the first motor and the second motor further each comprise a bore for providing hydraulic fluid communication with the motor.

6. The rotary apparatus of claim 1 wherein the axially rotatable groundworking implement comprises a cold planer.

7. The rotary apparatus of claim 1 wherein the at least one motor shaft is nonrotatably affixed to the axially rotatable groundworking implement supporting means, and the at least one motor casing is affixed to the axially rotatable groundworking implement to thereby be rotatable therewith.

8. The rotary apparatus of claim 1 further comprising a frame connected to the axially rotatable groundworking implement supporting means, means for connecting the frame to a host vehicle having a hydraulic source, and means for connecting the primary hydraulic fluid input means and the primary hydraulic fluid output means to the host vehicle hydraulic source.

9. A rotary apparatus comprising:

means for supporting an axially rotatable groundworking implement, an axially rotatable groundworking implement having an axis of rotation and opposing first and second ends, the groundworking implement being rotatable with respect to the axially rotatable groundworking implement supporting means, at least one hydraulic motor comprising a casing, a shaft, and hydraulic fluid input and output ports, the motor casing being substantially disposed between the first and second ends, primary hydraulic fluid input means, primary hydraulic fluid output means, the primary hydraulic fluid input means being in communication with the input port of the at least one hydraulic motor, the primary hydraulic fluid output means being in communication with the output port of the at least one hydraulic motor, such that hydraulic fluid may flow from the input means to the output means through the at least one hydraulic motor, the casing of the at least one hydraulic motor being affixed to the axially rotatable groundworking implement to thereby be rotatable therewith.

10. The rotary apparatus of claim 9 wherein the primary hydraulic fluid input means introduces fluid which passes through the first end of the groundworking implement, and the primary hydraulic fluid output means removes fluid which passes through the second end of the groundworking implement.

11. The rotary apparatus of claim 9 wherein the motor input port in communication with the primary hydraulic fluid input means and the motor output port in communication with the primary hydraulic fluid output means are coaxial with the axis of rotation of the axially rotatable groundworking implement.

12. The rotary apparatus of claim 9 wherein the shaft of the at least one hydraulic motor further comprises a bore therein such that the bore comprises either the hydraulic fluid input port or output port.

13. The rotary apparatus of claim 9 wherein the at least one hydraulic motor comprises a first motor and a second motor, the first motor being in fluid communication with the second motor.

14. The rotary apparatus of claim 9 further comprising a frame and a means for laterally shifting the axially rotatable groundworking implement with respect to the frame.

15. The rotary apparatus of claim 9 wherein the axially rotatable groundworking implement comprises a cold planer.

16. The rotary apparatus of claim 9 further comprising a frame connected to the axially rotatable groundworking implement supporting means, means for connecting the frame to a host vehicle having a hydraulic source, and means for connecting the primary hydraulic fluid input means and the primary hydraulic fluid output means to the host vehicle hydraulic source.

17. A rotary apparatus comprising:

means for supporting an axially rotatable groundworking implement, an axially rotatable groundworking implement having an axis of rotation and opposing first and second ends, the groundworking implement being rotatable with respect to the axially rotatable groundworking implement supporting means, at least one hydraulic motor comprising a casing, a shaft, and hydraulic fluid input and output ports, the motor casing being substantially disposed between the first and second ends, primary hydraulic fluid input means, primary hydraulic fluid output means, the primary hydraulic fluid input means being in communication with the input port of the at least one hydraulic motor, the primary hydraulic fluid output means being in communication with the output port of the at least one hydraulic motor, such that hydraulic fluid may flow from the input means to the output means through the at least one hydraulic motor, the shaft of the at least one hydraulic motor being nonrotatably affixed to the axially rotatable groundworking implement supporting means.

18. The rotary apparatus of claim 17 wherein the primary hydraulic fluid input means introduces fluid which passes through the first end of the groundworking implement, and the primary hydraulic fluid output means removes fluid which passes through the second end of the groundworking implement.

19. The rotary apparatus of claim 17 wherein the motor input port in communication with the primary hydraulic fluid input means and the motor output port in communication with the primary hydraulic fluid output means are coaxial with the axis of rotation of the axially rotatable groundworking implement.

20. The rotary apparatus of claim 17 wherein the shaft of the at least one hydraulic motor further comprises a bore therein such that the bore comprises either the hydraulic fluid input port or output port.

21. The rotary apparatus of claim 17 wherein the at least one hydraulic motor comprises a first motor and a second motor, the first motor being in fluid communication with the second motor.

22. The rotary apparatus of claim 17 further comprising a frame and a means for laterally shifting the axially rotatable groundworking implement with respect to the frame.

23. The rotary apparatus of claim 17 wherein the axially rotatable groundworking implement comprises a cold planer.

24. The rotary apparatus of claim 17 further comprising a frame connected to the axially rotatable groundworking implement supporting means, means for connecting the frame to a host vehicle having a hydraulic source, and means for connecting the primary hydraulic fluid input means and the primary hydraulic fluid output means to the host vehicle hydraulic source.

25. A rotary apparatus comprising:

means for supporting an axially rotatable groundworking implement, an axially rotatable groundworking implement having an axis of rotation, the implement being rotatable with respect to the axially rotatable groundworking implement supporting means, at least one hydraulic motor comprising a casing, a shaft, and hydraulic fluid input and output ports, the hydraulic motor shaft comprising a bore therein such that the bore comprises either the hydraulic fluid input port or output port, primary hydraulic fluid input means, primary hydraulic fluid output means, the primary hydraulic fluid input means being in communication with the input port of the at least one hydraulic motor, and the primary hydraulic fluid output means being in communication with the output port of the at least one hydraulic motor, such that hydraulic fluid may flow from the input means to the output means through the at least one hydraulic motor.

26. The rotary apparatus of claim 25 wherein the at least one hydraulic motor comprises a first motor and a second motor, the first motor being in fluid communication with the second motor.

27. The rotary apparatus of claim 25 wherein the axially rotatable groundworking implement further comprises opposing first and second ends, and wherein the at least one motor casing is substantially disposed between the first and second ends.

28. The rotary apparatus of claim 25 wherein the axially rotatable groundworking implement comprises a cold planer.

29. The rotary apparatus of claim 25 wherein the at least one hydraulic motor shaft is nonrotatably affixed to the axially rotatable groundworking implement supporting means, and the at least one motor casing is affixed to the axially rotatable groundworking implement to thereby be rotatable therewith.

30. The rotary apparatus of claim 25 further comprising a frame connected to the axially rotatable groundworking implement supporting means, means for connecting the frame to a host vehicle having a hydraulic source, and means for connecting the primary hydraulic fluid input means and the primary hydraulic fluid output means to the host vehicle hydraulic source.

31. A rotary apparatus comprising:

means for supporting an axially rotatable groundworking implement, an axially rotatable groundworking implement having an axis of rotation and opposing first and second ends, the groundworking implement being rotatable with respect to the axially rotatable groundworking implement supporting means, at least one hydraulic motor comprising a casing, a shaft, and hydraulic fluid input and output ports, the motor casing being substantially disposed between the first and second ends, primary hydraulic fluid input means, primary hydraulic fluid output means, the primary hydraulic fluid input means being in communication with the input port of the at least one hydraulic motor, the primary hydraulic fluid output means being in communication with the output port of the at least one hydraulic motor, such that hydraulic fluid may flow from the input means to the output means through the at least one hydraulic motor, means for attaching the at least one hydraulic motor to the axially rotatable groundworking implement, means for connecting the at least one hydraulic motor to the axially rotatable groundworking implement supporting means, the connecting means comprising fasteners which are removable to allow the groundworking implement to be removed from the groundworking implement supporting means without detaching the attaching means.

32. The rotary apparatus of claim 31 wherein the attaching means attaches the casing of the at least one hydraulic motor to the axially rotatable groundworking implement such that the casing is thereby rotatable therewith, and wherein the connecting means connects the shaft of the at least one hydraulic motor to the axially rotatable groundworking implement supporting means to prevent relative rotation therebetween.

33. The rotary apparatus of claim 31 wherein the axially rotatable groundworking implement supporting means includes a protective cover.

34. The rotary apparatus of claim 31 further comprising at least one ground engaging depth control member pivotally connected to the protective cover.

35. The rotary apparatus of claim 31 wherein the connecting means comprises the shaft of the at least one hydraulic motor.

36. The rotary apparatus of claim 35 wherein the connecting means comprises a support hub, the support hub being connectable to the protective cover with the fasteners, the support hub being non-rotationally coupled with the shaft.

37. The rotary apparatus of claim 31 wherein the at least one hydraulic motor comprises a first motor and a second motor, the first motor being in fluid communication with the second motor.

38. The rotary apparatus of claim 31 wherein the primary hydraulic fluid input means introduces fluid which passes through the first end of the groundworking implement, and the primary hydraulic fluid output means removes fluid which passes through the second end of the groundworking implement.

39. The rotary apparatus of claim 31 wherein the motor input port in communication with the primary hydraulic fluid input means and the motor output port in communication with the primary hydraulic fluid output means are coaxial with the axis of rotation of the axially rotatable groundworking implement.

40. The rotary, apparatus of claim 31 wherein the shaft of the at least one hydraulic motor further comprises a bore therein such that the bore comprises either the hydraulic fluid input port or output port.

41. The rotary apparatus of claim 31 wherein the axially rotatable groundworking implement comprises a cold planer.

42. A rotary apparatus comprising:

means for supporting an axially rotatable groundworking implement, said means comprising a protective cover having an interior space which partially receives a groundworking implement, an axially rotatable groundworking implement having an axis of rotation and opposing first and second ends, the groundworking implement being rotatable with respect to the axially rotatable groundworking implement supporting means, at least one hydraulic motor comprising a casing, a shaft, and hydraulic fluid input and output ports, the motor casing being substantially disposed between the first and second ends, primary hydraulic fluid input means, primary hydraulic fluid output means, the primary hydraulic fluid input means being in communication with the input port of the at least one hydraulic motor, the primary hydraulic fluid output means being in communication with the output port of the at least one hydraulic motor, such that hydraulic fluid may flow from the input means to the output means through the at least one hydraulic motor, means for attaching the at least one hydraulic motor to the axially rotatable groundworking implement, means for connecting the at least one hydraulic motor to the axially rotatable groundworking implement supporting means, the connecting means comprising fasteners which are removable to allow the groundworking implement to be removed from the groundworking implement supporting means, said fasteners positioned to be disconnectable from the groundworking implement supporting means at a location exterior to the protective cover interior space.

43. The rotary apparatus of claim 42 wherein the fasteners are connectable with the protective cover.

44. The rotary apparatus of claim 42 wherein the connecting means comprises the shaft of the at least one hydraulic motor.

45. The rotary apparatus of claim 44 wherein the connecting means comprises a support hub, the support hub being connectable to the protective cover with the fasteners, the support hub being non-rotationally coupled with the shaft.

46. The rotary apparatus of claim 42 wherein the primary hydraulic fluid input means introduces fluid which passes through the first end of the groundworking implement, and the primary hydraulic fluid output means removes fluid which passes through the second end of the groundworking implement.

47. The rotary apparatus of claim 42 wherein the shaft of the at least one hydraulic motor further comprises a bore therein such that the bore comprises either the hydraulic fluid input port or output port.

* * * * *